US005329946A

United States Patent [19]

Guma

[11] Patent Number: 5,329,946

[45] Date of Patent: Jul. 19, 1994

[54] HAIR LINE SHAPING GUIDE

[76] Inventor: Tesfa Guma, 9607 Wadsworth Dr., Bethesda, Md.

[21] Appl. No.: 135,968

[22] Filed: Oct. 14, 1993

[51] Int. Cl.[5] ..... A45D 24/34

[52] U.S. Cl. ..... 132/213.1; 132/214

[58] Field of Search ..... 132/148, 150, 152, 154, 132/213, 213.1, 214, 215, 219, 319; 30/289, 290, 291; D28/21, 23, 25, 44

[56] References Cited

U.S. PATENT DOCUMENTS

| | | | |
|---|---|---|---|
| 435,748 | 9/1890 | Hollinshead | 132/215 |
| 780,422 | 1/1905 | Hagen | 132/215 |
| 1,385,722 | 7/1921 | Sessoms | 132/214 |
| 1,517,166 | 11/1924 | Powers | 132/214 |
| 2,550,972 | 5/1951 | Cohen | 132/214 |
| 3,277,902 | 10/1966 | Korst | 132/214 |
| 3,407,823 | 10/1968 | Selvaggio | 132/214 |

*Primary Examiner*—Gene Mancene
*Assistant Examiner*—Frank A. LaViola
*Attorney, Agent, or Firm*—Ramik, Vincent L.

[57] ABSTRACT

A hair line shaping guide which acts as a templet and enables a shaver to shave his face, chin, neck and head in any desired and predetermined pattern. The templet has one straight edge on one side, two types of curves on the other side and plurality of holes for attachment of auxiliary, related components which can, with the help of the holes, be moved vertically or rotated clockwise or counter-clockwise. When the templet is put against the face area needing patterned shaving the razor and hair cutting instruments can be guided by the selected curve on the templet and give the shaver a clean shave with neat smooth hair line. When the auxiliary templet for patterning mustache is attached to the main templet and superimposed on the mustache it guides the razor and hair cutting instruments to give any desired pattern of mustache. When comb is attached to the main templet the device can also be used for combing hair. The hair line shaping guide can be folded in half for compact packing and storing.

6 Claims, 1 Drawing Sheet

HAIR LINE SHAPING GUIDE

This invention relates to apparatus for helping a user to shave a body hair in any desired pattern. More specifically the invention relates to shaving of human hair above the neck, such as facial hair or beard, side-burns, mustache, neck and head, giving the hair line any desired straight line or curved line.

Facial hair and head hair shaving is a regular, often daily chore with which we have to contend. People do not shave their facial or head hair always the same way. Those who shave often try to form various hair line curves according to their individual desire. Many shavers cannot form perfect hair line curves easily and therefore live with their short-comings. One primary alternative is to have it done at barber shops at cost. Many of the would-be shavers are therefore restrained from giving themselves cleanly lined facial appearance of their choice. The other alternative left to these people is either to shave their face compeletely or wear heavy beard against their whishes.

Up to the present there is no known mechanism to help the would-be shavers to give themselves an appropriate facial hair line.

OBJECT OF THE INVENTION

The object of the present invention is to provide an apparatus which can be used as templet which guides shaving razor or hair cutting instruments to follow predetermined lines and create any desired shape of beard, side burns, mustache, neck hair and head hair with correct and smooth lines and curves.

Another object of the invention is to enable any would-be patterned beard wearer to do so neatly without defficulty anywhere and at any time.

Yet another object of the invention is to provide the would-be patterned beard wearer with a cheap but efficient means to achieve patterning of his hair or maintaining of existing pattern without any help and yet at no financial cost and in very little time.

SUMMARY OF THE INVENTION

The preferred invention comprises of a frame of a templet which has a number of different lines and curves on or around it. The templet has a handle and is movably attached to secondary templets for the various patterns of hair on mustache and chin. The apparatus is made of a simple, very light, inexpensive and compact piece of object.

BRIEF DESCRIPTION OF THE DRAWING

In the drawings which illustrate an embodiment of the invention.

DETAILED DESCRIPTION OF THE PREFERRED EMBODIMENT

Figure 1:
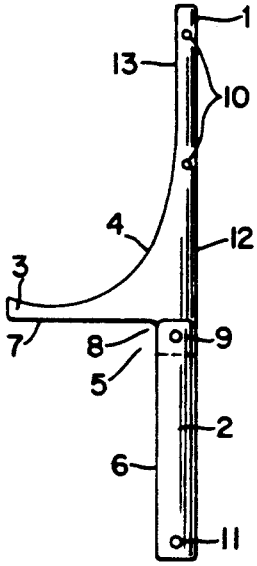
FIG. 1 is a view of the main frame of facial hair line shaping templet with its essential component curves and shapes.
Figure 2:
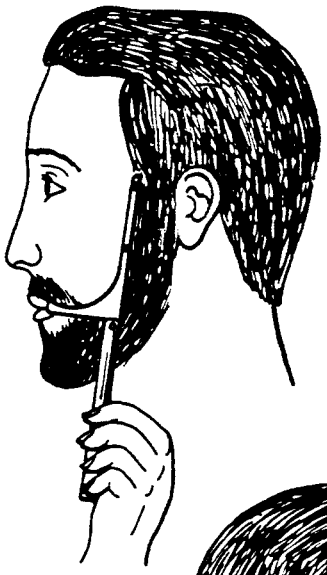
FIG. 2 is a side view of human face with the templet device in position to guide a hair cutting or shaving instrument to give the beard a curved pattern.
Figure 3:
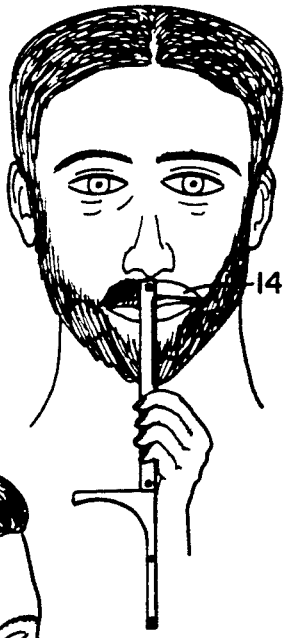
FIG. 3 is a front view of a human face with the templet fitted with a mustache templet to guide any hair cutting or shaving instrument to shape the mustache line in a downward curved pattern.
Figure 4:
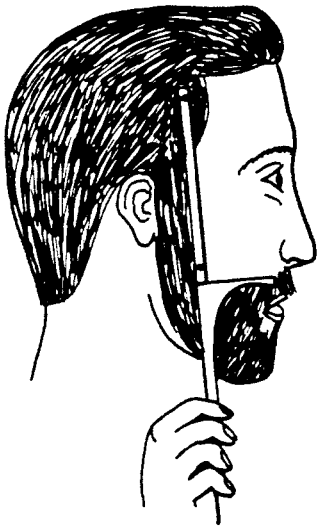
FIG. 4 is another side view of a human face with the templet turned up side down and positioned on the face in order to guide a hair cutting or shaving instrument to shape the beard in a right angled straight line pattern.
Figure 5:
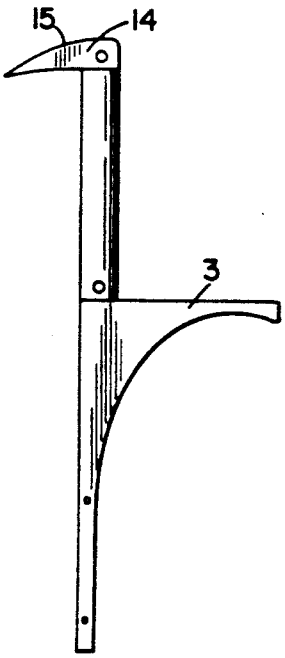
FIG. 5 is a view of the templet with downward curve mustache pattern rotatably pinned to it at one end.
Figure 6:
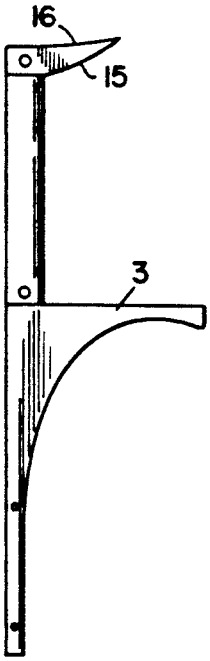
FIG. 6 is a view of the templet with the pinned mustache pattern rotated to the opposite side of the templet to show an upward curving mustache pattern.

Referring to the drawings, FIG. 1 shows the main templet frame 1 of the new invention with three distinctive components 1, 2, and 3. Component 1 has a straight edge 12 on one of the two sides of the main templet frame extending from one extremity of component 1 to the other extremity of component 2. Component 3 is an object which comprises curve 4 on one side and curve 5 on its other side - Component 3 has a straight line edge 13 tward its upper extremity where it blends with the main templet frame component 1, and curves out away from main templet frame at its lower area , thus forming curve 4 which is patterned to conform with the general feature of cleanly and carefully shaped curve of a side burn and beard of a man. The other side 7 of component 3 is a straight line which meets component 2 of main templet frame at a right angle at point 8 to form curve 5. As shown in FIG. 2, when the templet is placed against the face the razor can follow the smooth curved edge and create a clean smoothly shaven neatly curved side burns and beard pattern of the face. The templet can be moved vertically or sideways to carve out any desired beard pattern. As shown in FIGS. 1 and 4 the main templet frame of FIG. 1 is turned up-side-down and positioned on the bearded face so that the right angle curve 5 forms a right angled pattern on the bearded face. The razor, when shaving the beard in this pattern, can follow the smooth edges of the templet and create a clean and smooth right angled pattern of the beard. The templet can be moved vertically or sideways to create any right angled beard pattern on the face. As shown in FIGS. 5 and 6 the main templet frame 1 is fitted with mustache pattern 14 at one end. Mustache pattern 14 in this preferred embodiment curves downward. As shown in FIG. 3, when the mustache pattern is supperimposed on the mustache it creates a mustache pattern which curves down ward with its upper side 15. FIG. 6 shows yet another way of forming a different, upward crying mustache pattern by simply rotating the original pattern 14 of FIG. 5 over to the opposite side of the main templet. This positions the upward curving side 16 of the mustache pattern to facilitate the creation of appropriate upward curving mustache. In order to create a straight mustache without any apparent curve, any of the straight edges on the templet frame can be used. Furthermore, in order to shave a patterned chin below the lower lip straight edge of curve 4 of component 3 of the main templet frame can be used by superimposing the templet on the chin at an appropriate angle. All edges of the templet frame are smooth so as to enable a razor to shave the hair with neat lines in a desired pattern.

Figure 7:
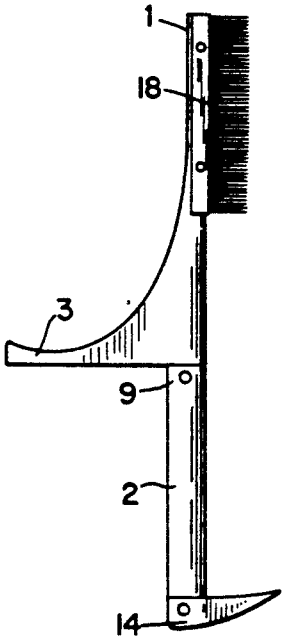
FIG. 7 is a view of a foldable templet fitted with combs at one end and a mustache pattern at the other end.
Figure 8:
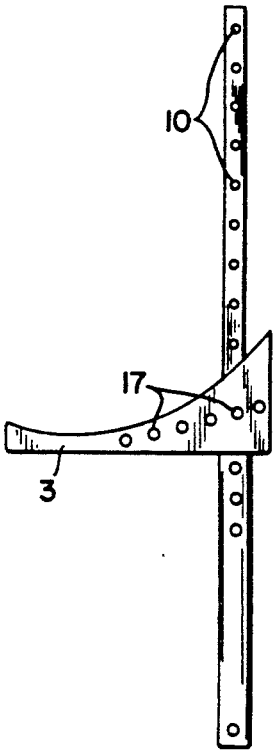
FIG. 8 is a view of the main templet frame with the curve component separately made and rotatably attached to it around the attachment point and movable vertically for fixing in different positions.

As shown in FIGS. 7 and 8, holes 10 in the main templet frame facilitate attachment of combs 18, as well as separately made curve component 3 with holes 17 in it, to the main templet frame. The plurality of holes 10 in the main templet frame, and holes 17 in separately made rotatable curve component 3 facilitate vertical and angular positioning and adjustment of curve component 3 along the length of the main templet frame thus facilitating creation of wide variety of facial hair line curves. Hole 11 is also to pin the mustache pattern 14 to the other extremity of the main templet frame. Hole 9 at the junction of components 1 and 2 of the main templet frame facilitates pinning of the two main components 1 and 2 together to make the whole apparatus foldable for compact handling, packing and storage.

It will be apparent that modifications, alterations and substitutions may be made in the heretofore described embodiments without departing from the spirit and objectives of the invention. Therefore the invention is to be limited only by the scope of the following appended claims.

I claim:

1. A hair line shaping guide comprising:

a main templet having a longitudinal axis extending between a first end and a second end and a length therebetween, said main templet having a smooth straight edge extending along a first edge between said first and second ends and a curved surface extending along a second edge from said first end to approximately a midway point between said first and second ends, said curved surface terminating at a terminal point spaced away from said longitudinal axis and forming a horizontal curving arm generally perpendicular to said longitudinal axis, said curved surface defining a J-shaped curve, said horizontal curving arm having a straight edge opposite said curved surface, said straight edge extending from said terminal point back to said second edge and forming a right angle therewith, a portion of said second edge from said midway point to said second end being straight and smooth and a plurality of holes located along the length of said main templet, whereby said J-shaped curve and said right angle are used to shape and style hair of a user while cutting or shaving.

2. The hair line shaping guide of claim 1, wherein said curved surface and said horizontal curving arm are formed of one piece.

3. The hair line shaping guide of claim 1, wherein said horizontal curving arm is formed of a separate piece and is attached to the main templet at a point of rotation to allow for vertical movement and axial rotation to permit said J-shaped curve to be altered slightly.

4. The hair line shaping guide of claim 1, wherein auxiliary components are attached through said plurality of holes.

5. The hair line shaping guide of claim 4, wherein said auxiliary component is a comb.

6. The hair line shaping guide of claim 4, wherein said auxiliary component is a mustache patterning guide, said mustache patterning guide being formed in a tusk shape having a first and second curving sides, said first curving side being more pronounced than said second curving side; said mustache patterning guide having a wide end and a point opposite said wide end, said wide end having a hole therethrough for alignment with a hole of said main templet to allow for rotatable receipt with the main templet and allowing each curved side to form different mustache patterns.

* * * * *